US005407279A

United States Patent [19]

Marsik

[11] Patent Number: 5,407,279

[45] Date of Patent: Apr. 18, 1995

[54] MULTI-PLY AUTOMATIC-STYLE BAG WITH INTERNAL FLAP OR FLAPS

[75] Inventor: Ronald Marsik, Willow Springs, Ill.

[73] Assignee: Bagcraft Corporation of America, Chicago, Ill.

[21] Appl. No.: 174,409

[22] Filed: Dec. 28, 1993

[51] Int. Cl.[6] ..... B65D 30/18; B65D 30/20

[52] U.S. Cl. ..... 383/115; 383/104

[58] Field of Search ..... 383/114, 115, 126, 104

[56] References Cited

U.S. PATENT DOCUMENTS

| | | | |
|---|---|---|---|
| 1,789,807 | 1/1931 | Currier | 383/114 |
| 2,246,911 | 6/1941 | Baker | 383/114 |
| 2,420,212 | 5/1947 | Volksdorf | 383/115 |
| 2,569,964 | 10/1951 | Waters | 383/115 |
| 2,729,150 | 1/1956 | Gelbcke | 383/115 |
| 2,892,580 | 6/1959 | Williams | 383/114 |
| 3,231,173 | 1/1966 | Ciuitello | 383/115 |
| 3,409,210 | 11/1968 | Barris et al. | 383/115 |

*Primary Examiner*—Stephen P. Garbe
*Attorney, Agent, or Firm*—Seyfarth, Shaw, Fairweather & Geraldson

[57] ABSTRACT

A multi-ply square bottom bag having a front wall, a back wall, a pair of gusseted side walls, each joining a front and a back panel, and a folded and gusseted bottom panel defining a pair of interior spaced gusset edges extending between the front and back panels with the edges being substantially parallel to each other and the bottom panel joining the front, back and side panels. The multi-ply bag has an inner ply and an outer ply. The inner ply defines a first flap adapted to be positioned to engage said bottom panel and overlie at least a first portion of said gusset edges. The first flap is formed from the front wall section of the inner ply and is constructed to rotate about a hinge line to a position adjacent the bottom panel and overlying the gusset edges, The inner ply also define a second flap adapted to engage said bottom panel and overlie a second portion of said gusset edges so that said first flap and said second flap overlie substantially the entire length of the gusset edges between the front and back wall. The second flap is formed from the back wall section of the inner ply and is constructed to rotate about a hinge line to a position in engagement with the bottom panel and overlie gusset edges. An adhesive on the bottom panel exposed between said gusset edges secures the first and said second flaps in position.

13 Claims, 2 Drawing Sheets

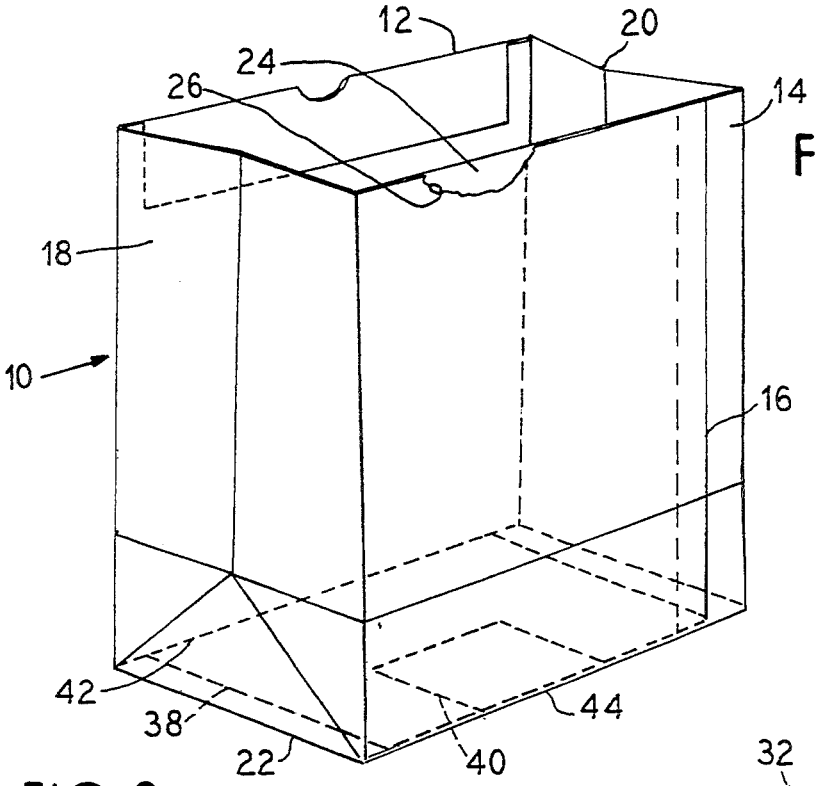
FIG. 1
FIG. 2
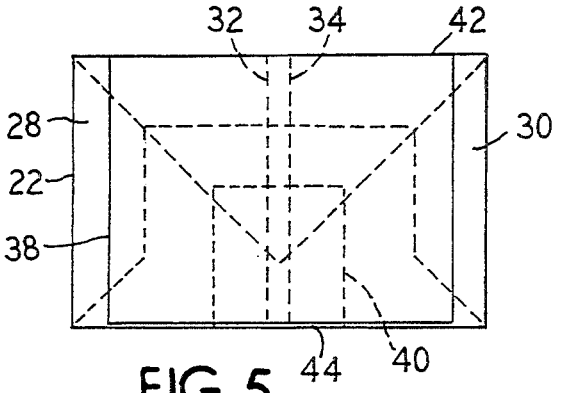
FIG. 3
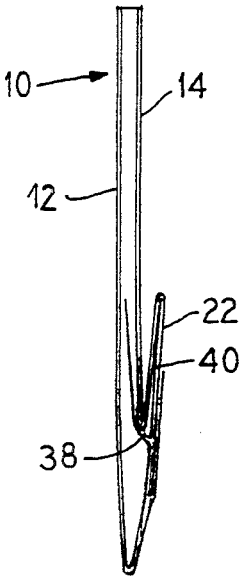
FIG. 4
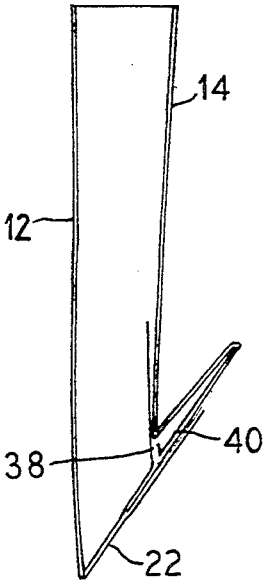
FIG. 5
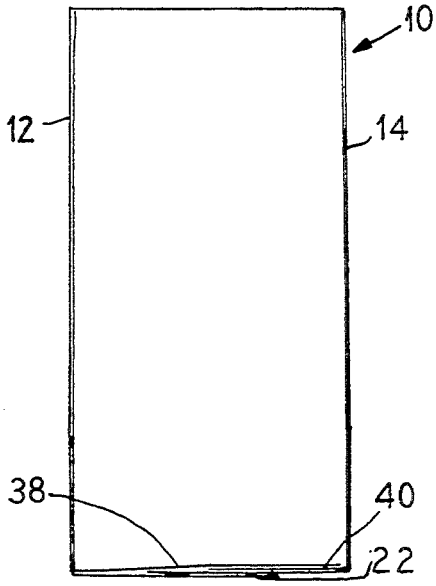

FIG. 6
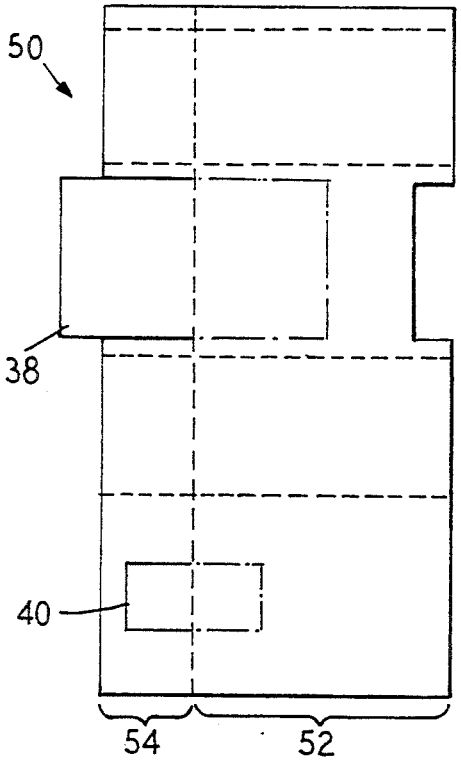
FIG. 8
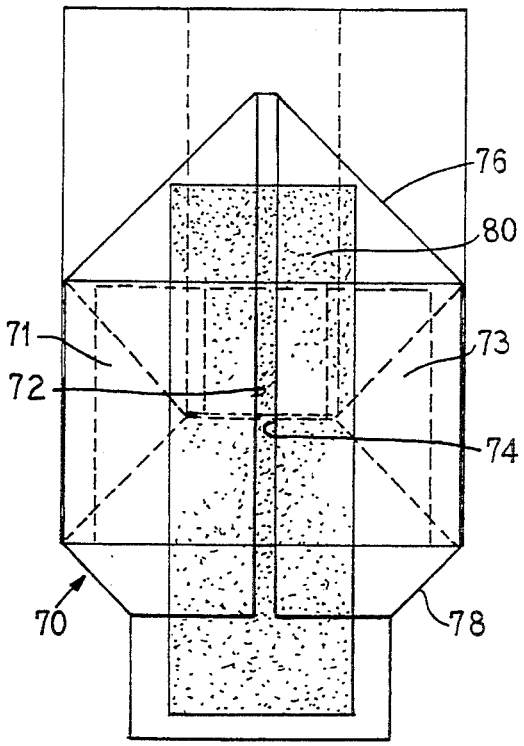
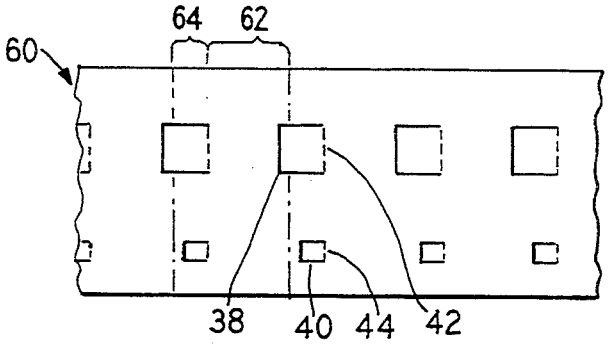
FIG. 7
FIG. 9
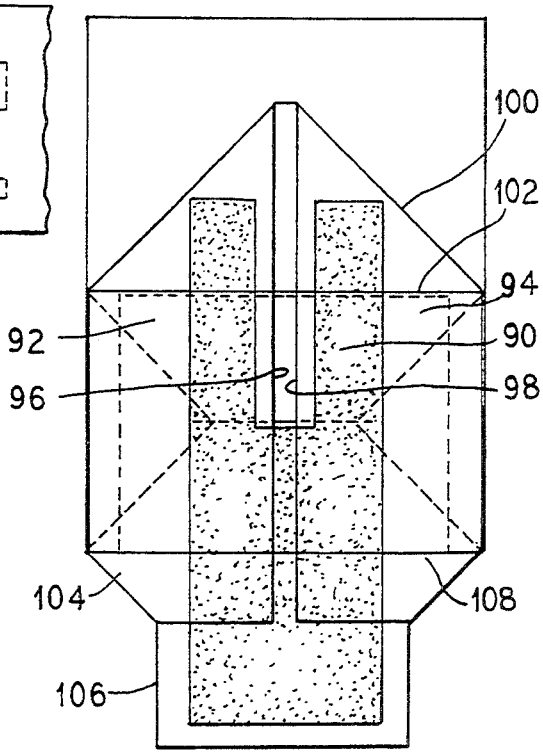

MULTI-PLY AUTOMATIC-STYLE BAG WITH INTERNAL FLAP OR FLAPS

BACKGROUND OF THE INVENTION

This invention relates to improvements in a square bottom bag having an internal flap or patch.

Square bottom bags are commonly used for carrying various types of items. A square bottom bag can be "snapped" open and then set upright onto a supporting surface and maintain the upright positioning while the bag is loaded.

Such bags are used in grocery stores and receive prepackaged products, loose items, grains, flours and packaged liquids. These bags are also used in restaurants to carry sandwiches, liquids, condiments and the like.

These bags usually have front, side and back panels and a gusseted and folded bottom panel. Viewed from inside the bag bottom panel exhibits two internal folds, each of which have a centrally positioned free edge (referred to as a gusset edge). The edges are parallel and closely spaced but form a gap. These edges generally extend between the front and back walls and are parallel to the side walls.

It has been found that granular or flour-like materials and liquids tend to seep or leak from the bag interior through the bottom and to the exterior.

One technique to minimize this seepage is disclosed in Faltynek et al Canadian patent application "Bag With Internal Proactive Flap", Ser. No. 2,064,181-9, Filing Date Mar. 26, 1992 and laid open Mar. 3, 1993. That application discloses a single separate member that is glued to the bag interior adjacent the bottom and front walls so as to form a flap and is pulled into contact with the bottom by glue spots on the bottom. However, this bag has not become commercial and a more readily manufactured bag is desirable.

Recently multi-ply bags have become very popular and it is desirable to provide a flap system for use therein.

It is a further object of this invention to make the flap integral with the bag, especially with the inner ply.

Moreover, it is another object of this invention to further reduce or minimize leakage or seepage and increase the bag integrity.

These and other objects of this invention will become apparent from the following disclosure and appended claims.

SUMMARY OF THE INVENTION

There is disclosed herein a multi-ply square bottom bag which includes a primary flap only or a primary and a secondary flap which are integral with an inner ply of the bag, are arranged to engage the bag bottom and overlies the gusset edges. The flap(s) disclosed herein minimize seepage or leakage from the bag interior. The bag includes a front wall, a back wall, a pair of gusseted side walls and a gusseted bottom wall having a pair of inner or centrally positioned edges.

The bag has an inner ply and an outer ply. The inner ply is die cut and scored so as to define the primary flap or the primary and the secondary flap. These flap(s) include free edge portions and a hinge line. The edges and the hinge line together define each flap. Each flap is integral with the inner ply and joined thereto along the hinge line at the junction of the bottom panel and either the front wall or the back wall. The primary flap is normally associated with the front wall and bottom panel. The secondary flap is normally associated with the back panel and bottom panel.

Each flap is constructed to rotate from a position associated with the front or back wall when the bag is closed to a position overlying the bottom panel when the bag is open.

Each flap is adhesively secured to the bottom between the gusset edges. Moreover, each flap is positioned, upon the bag opening, to overlie space between the gusset edges at the center of the bottom (i.e., those edges extending between the front and back walls). This positioning of the flap(s) has the effect of sealing the edges so as to minimize leakage or seepage.

BRIEF DESCRIPTION OF THE DRAWINGS

FIG. 1 is a perspective view of the bag of this invention;

FIG. 2 is a view of the bag bottom with the primary and secondary flaps taken from within the bag;

FIG. 3 is a side and sectional view of a bag closed with the flap(s) in a closed position;

FIG. 4 is a side and sectional view, like FIG. 3, of the bag of FIG. 3 partially opened;

FIG. 5 is a side and sectional view, like FIG. 4, of the bag of FIG. 3 fully opened;

FIG. 6 is a development like view of a blank-like inner ply for a bag;

FIG. 7 is a development-like view, like FIG. 6, but shows the inner ply in web form;

FIG. 8 is a view of the exterior of the bottom of the bag as it is being folded and glue applied thereto showing the glue pattern for the primary and secondary flap; and FIG. 9 is like FIG. 8 but shows the glue pattern for the primary flap only.

DESCRIPTION OF THE PREFERRED EMBODIMENT

Turning now to the drawing, there is shown in FIG. 1 a square bottom bag 10 generally which includes a front wall 12, back wall 14 having an overlapping seam line 16, a pair of gusseted side walls 18 and 20, and a folded and gusseted square bottom panel 22.

The bag walls are multi-ply and are formed from an inner ply 24 and an outer ply 26 that are adhesively bonded to each other.

The bottom is formed by folding extensions of the front, back and side walls. Referring to FIG. 2, the bottom panel 22 is shown as it appears from the inside of the bag.

From the inside, the bottom includes two folded gussets 28 and 30 that extend inwardly from the side edges. These inner gussets terminate in spaced parallel edges 32 and 34 that extend between the front and back walls of the bag. The portion between the edges 32 and 34 is a part of the remaining portion of the bottom fold.

In accordance with this invention, an adhesive applied to the bottom during bag formation is exposed to the bag interior between the edges.

A primary flap 38 is formed integral with the inner ply 24 at the front wall 12. A secondary flap 40 is formed integral with the inner ply at the back wall 14. Each of the flaps is arranged to at least partially overlie the spaced edges 32 and 34 and be secured to the bottom 22. In this embodiment, each of the flaps is rectangular, has three cut edges and a scored hinge line, such as 42 and 44, by which the flap is joined to the inner ply at the junction of the bottom panel and front or back wall.

The secondary flap 40 is smaller than the primary flap 38 and the secondary flap is adhered to the bottom along a line running from its hinge line 44 to the opposite end. The secondary flap extends inwardly or from the back wall toward the front wall, for a distance slightly greater than one-half the distance between the front and back walls. This is done so as to assure eventual glue application to the bottom adheres to the secondary flap as opposed to the front wall. In the specific embodiment the flap is one-fourth inch larger than one-half the front/back distance.

The primary flap is substantially larger than the secondary flap but is smaller than the bottom in both length and width. The primary flap extends from the front wall, is adhered to the bottom along the gusset edges from its hinge line 42 for about one-half the distance from the front to back wall. The remaining and unadhered part of the primary flap overlies the adhered secondary flap. In this way the leakage or seepage of material through the bag bottom, particularly at the edges, is minimized and the edges 32 and 34 are effectively sealed.

FIGS. 3, 4 and 5 show steps in the sequence of bag opening. In FIG. 3, the bag 10 is shown in the closed condition with the bottom 22 folded up against the back wall 14 and front wall 12. In this position the secondary flap 40 is against the bottom and extends from the back wall/bottom junction. The primary flap 38 extends from the front wall, is secured to the bottom for about one-half the distance to the back wall, engages the back wall and is arranged to overlie the secondary flap. In opening the bag, the front and back walls separate and the bottom panel rotates downward.

A secondary flap 40 is secured in place against the bottom 22. The primary flap 38 which is partially secured to the bottom and also restrained by the back wall begins to move downwardly. FIG. 4 shows a partially opened bag with the front and back walls spaced apart, the secondary flap secured to the bottom, and the primary flap being partially secured to the bottom and still being restrained by the back wall.

A fully opened bag is shown in FIG. 5 with the primary and secondary flaps in position overlying the bottom. Note that the primary flap overlies the bottom and the secondary flap.

FIG. 6 shows the inside of a bag or a development of the inner ply. A blank for the inner ply 50 includes a right-hand portion 52 from which the front, back and side panels are formed. The left-hand portion 54 is in a sense an extension of the front, back and side panels and is the portion that is folded to form the bottom. The primary flap is shown as 38 and the secondary flap as 40.

In FIG. 7 there is shown a web 60 from which the blank of FIG. 6 is prepared. The inner ply is adhered to the outer ply to form the multi-ply bag. The right-hand side 62 forms the front, back and side walls with the outer ply and is similar to portion 52. The primary and secondary flaps 38 and 40 are shown and as well as their scored hinge lines 42 and 44. The left-hand part 64 is folded and used to form the bottom wall 22.

Referring now to FIG. 8, the exterior of the bag bottom is shown after initial folding and ready for the final stage of folding. Here the bottom 70 is shown which includes two square sections 71 and 73 and two edges 72 and 74 (like 32 and 34) that have been folded inwardly. A first flap 76 which is triangularly shaped is formed. A second flap 78 which is basically triangularly shaped but with a rectangular shaped end is also formed. A glue pattern 80, shown by the stipple marks, is applied to the bottom. It is seen that the glue pattern extends across the gap formed by the edges 72 and 74 and is in effect applied to the internal primary and secondary flaps. The first flap 76 is swung into place against the square section 71 and 73. Then the second flap 78 is swung into place against the first flap. The glue pattern 80 assures securement of the first and second flaps to the bottom and each other. Moreover, by being able to span the edges (such as 72 and 74) with glue carrying flaps, securement of the primary and secondary flaps 38 and 40 to the bottom is assured.

With this construction, the bag 10 has maximized its resistance to seepage and leakage from the bag interior through the bottom to the bag exterior. An important feature of the leakage and seepage resistance relates to the fact that the primary and secondary flaps are formed from the inner plies and thus the number of seams or places of joinder at which leakage can occur is minimized. Moreover, since the bag is multi-ply, the inner ply can be made of moisture resistant materials such as a polyethylene film or waxed paper, an absorbent material, or the like.

FIG. 9 is similar to FIG. 8 except that the glue pattern as shown by the stippling 90 is significantly different and arranged for a bag which employs a primary flap only. FIG. 9 shows the bottom of a bag before final folding. The bag bottom includes two side flaps 92 and 94 that define the gusset edges 96 and 98. The bag also includes a first triangular flap 100 that swings about the back wall/bottom junction 102. The lower flap 104 is shaped like a triangle but includes a squared flap 106 at its end and the entire flap can swing about the front wall/bottom junction 108. The glue pattern 90 is applied to the side, top and bottom flaps as shown but extends from the front wall/bottom junction 108 about half way toward the back wall, so as to adhesively secure the primary flap to the bottom while leaving the back wall unadhered. The bottom is finished by folding the first flap 100 onto the bottom and then the lower flap 104/106 onto the first flap and bottom. In this way securement of the primary flap only is assured.

This invention has been described in connection with the embodiments described above but numerous changes and modifications can be made to the embodiment without departing from the spirit and scope of the invention

I claim as my Invention:

1. A multi-ply square bottom bag having a front wall, a back wall, a pair of gusseted side walls, each joining a front and a back wall, and a folded and gusseted bottom panel defining a pair of interior spaced gusset edges extending between the front and back walls, said edges being substantially parallel to each other and extending between the front and back walls, and said bottom panel joining the front, back and side panels, and wherein the improvement comprises:

said multi-ply bag having an inner ply and an outer ply;

said inner ply defining a first flap adapted to be positioned to engage said bottom panel and overlie said gusset edges;

said first flap (a) being formed from said inner ply having a plurality of cut edges and a hinge line at which the flap is joined to the inner ply; (b) being formed from the front wall section of the inner ply;

and (c) being constructed to rotate about said hinge line to a position adjacent the bottom panel and overlying the gusset edges; and an adhesive applied to the bottom panel exposed between said gusset edges and engaging said flap for positioning the same adjacent the bottom panel.

2. An improved bag as in claim 1, wherein the adhesive extends from about the front wall about half the distance to the back wall.

3. An improved bag as in claim 1, wherein the first flap is hingedly joined to the inner ply along the junction of the front wall and the bottom panel.

4. An improved bag as in claim 1, wherein said inner ply is fabricated of a fluid impervious material and said bag is resistant to leakage and seepage.

5. An improved bag as in claim 1, wherein the first flap is rectangularly shaped so that said first flap overlies substantially the entire length of the gusset edges between the front and back walls.

6. An improved bag as in claim 1, wherein:

said inner ply also defines a second flap adapted to engage said bottom panel and overlie a portion of the spaced gusset edges;

said second flap (a) being formed from said inner ply and having a plurality of free edges and a hinge line at which the flap is joined to the inner ply; (b) being formed from the back wall section of the inner ply; and (c) being constructed to rotate about the hinge Line to a position in engagement with the bottom panel and overlie gusset edges;

whereby the first flap and second flap cooperate to overlie substantially the entire length of the gusset edges between the front and back walls ; and adhesive applied to the bottom panel, exposed between said gusset edges and engaging said second flap for positioning the same adjacent the bottom panel.

7. An improved bag as in claim 6, wherein said secondary flap engages said bottom panel and said primary flap is constructed to overlie at least a portion of said secondary flap.

8. An improved bag as in claim 6, wherein each of said first and said second flaps are rectangularly shaped.

9. An improved bag as in claim 6, wherein the second flap is hingedly joined to the inner ply along the junction of the rear wall and the bottom panel.

10. An improved bag as in claim 6, wherein each of the flaps are adhesively secured to the bottom panel along at least about one-half the length of the space defined by the gusseted edges.

11. An improved bag as in claim 10, wherein the first flap is a primary flap which is smaller than but about the size of the bottom panel but of a size to overlie a substantial portion of the bottom panel.

12. An improved bag as in claim 10, wherein the second flap is substantially smaller than the bottom panel and the primary flap.

13. A multi-ply square bottom bag having a front wall, a back wall, a pair of gusseted side walls, each joining a front and a back wall, and a folded and gusseted bottom panel defining a pair of spaced interior gusset edges extending between the front and back panels, said edges being substantially parallel to each other and extending between the front and back walls, and said bottom panel joining the front, back and side panels; and wherein the improvement comprises:

said multi-ply bag includes an inner ply and an outer ply;

said inner ply defining a first flap adapted to be positioned to engage said bottom panel and overlie at least a first portion of said gusset edges;

said first flap (a) being formed from said inner ply having a plurality of cut edges and a hinge line at which the flap is joined to the inner ply; (b) being formed from the front wall section of the inner ply; and (c) being constructed to rotate about said hinge line from a position adjacent the front wall to a position adjacent the bottom panel; and said inner ply also defining a second flap adapted to be positioned to engage said bottom panel and overlie at least a second portion of said gusset edges;

said second flap (a) being formed from said inner and having a plurality of free edges and a hinge line at which the flap is joined to the inner ply; (b) being formed from the back wall section of the inner ply; and (c) being constructed to rotate about said hinge line from a position adjacent the back wall to a position in engagement with the bottom panel so that said first flap and said second flap overlie substantially the entire length of the gusset edges between the front and back wall;

an adhesive applied to the bottom panel and exposed in the space between said gusset edges and engaging said first and said second flaps for positioning same adjacent the bottom panel;

the first flap is integral with and hingedly joined to the inner ply along the junction of the front wall and the bottom panel;

the second flap is integral with and hingedly joined to the inner ply along the junction of the rear wall and the bottom panel;

each of the flaps are adhesively secured to the bottom panel along at least about one-half the length of the exposed gusset edges;

the first flap is a primary flap which is smaller than about the size of the bottom panel but of a size to overlie a substantial portion of the bottom panel;

the second flap is a secondary flap which is substantially smaller than the bottom panel and smaller than the primary flap;

said secondary flap engages said bottom panel and said primary flap is constructed to overlie at least a portion of said secondary flap; and each said hinge line is formed of a score line in at least said inner ply.

* * * * *